United States Patent [19]

Egan

[11] 4,150,640

[45] Apr. 24, 1979

[54] FLUIDIC EXHAUST VALVE OPENING SYSTEM FOR AN ENGINE COMPRESSION BRAKE

[75] Inventor: John J. Egan, Canton, Ohio

[73] Assignee: Cummins Engine Company, Inc., Columbus, Ind.

[21] Appl. No.: 862,645

[22] Filed: Dec. 20, 1977

[51] Int. Cl.[2] ..... F02D 13/04

[52] U.S. Cl. ..... 123/97 B; 123/90.12; 123/198 F; 123/90.15

[58] Field of Search ..... 123/90.1, 90.11, 90.12, 123/90.13, 90.14, 90.15, 90.16, 90.55, 97 B, 75 E, 104, 105, 107, 139 DE, 198 DB, 198 F

[56] References Cited

U.S. PATENT DOCUMENTS

| | | | |
|---|---|---|---|
| 3,220,392 | 11/1965 | Cummins | 123/90.12 |
| 3,367,312 | 2/1968 | Jonsson | 123/97 B |
| 3,405,699 | 10/1968 | Laas | 123/90.12 |
| 3,439,662 | 4/1969 | Jones | 123/90.12 |
| 3,547,087 | 12/1970 | Siegler | 123/97 B |
| 3,786,792 | 1/1974 | Pelizzoni et al. | 123/90.16 |
| 3,859,970 | 1/1975 | Dreisin | 123/90.12 |
| 3,986,351 | 10/1976 | Woods | 123/105 |
| 4,033,304 | 7/1977 | Luria | 123/105 |

FOREIGN PATENT DOCUMENTS

| | | | |
|---|---|---|---|
| 2334711 | 1/1974 | Fed. Rep. of Germany | 123/97 B |
| 4639894 | 7/1968 | Japan | 123/97 B |

*Primary Examiner*—Charles J. Myhre
*Assistant Examiner*—Jeffrey L. Yates
*Attorney, Agent, or Firm*—Sixbey, Friedman & Leedom

[57] ABSTRACT

A compression braking system for an internal combustion engine having at least one working piston including a master piston operated by a fuel injector actuating mechanism and a slave piston fluidically connected with the master piston to open an engine exhaust valve wherein a fluid pressure control valve is provided to operate an exhaust valve opening delay means for delaying the opening of the exhaust valve to prevent the build up of excessive pressure in the fluid circuit between the master and slave pistons. The pressure relief valve is spring biased to sense fluid pressure above a predetermined level within the fluid circuit and to respond by venting fluid from the circuit to prevent thereby the exhaust valve from being opened against a variable closing bias exceeding a predetermined limit. The pressure relief valve has, in one embodiment, adjacent inlet and outlet ports while in a second embodiment the inlet and outlet ports are separated.

13 Claims, 3 Drawing Figures

FIG. 2
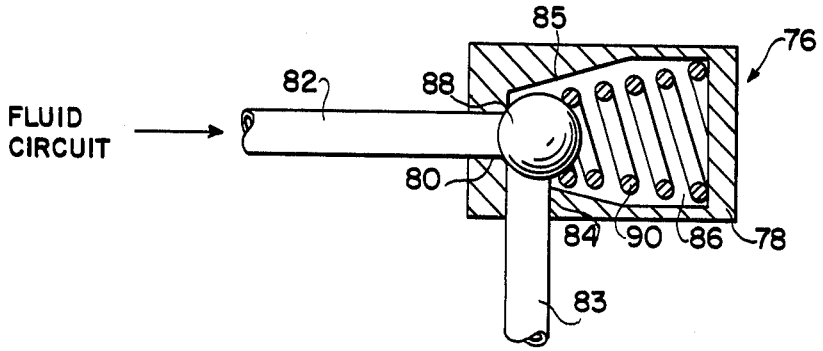
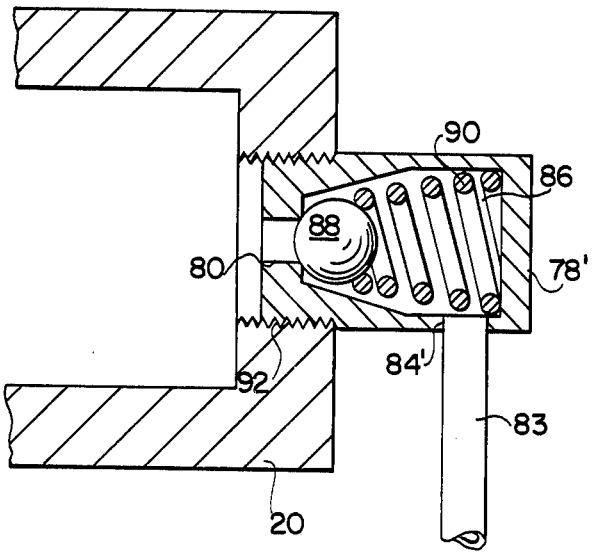
FIG. 3

FLUIDIC EXHAUST VALVE OPENING SYSTEM FOR AN ENGINE COMPRESSION BRAKE

BACKGROUND OF THE INVENTION

I. Field of the Invention

This invention relates to valve control systems for selectively operating an internal combustion engine in either a power mode or a retarding mode.

II. Discussion of the Prior Art

While the advantages of obtaining a braking effect from the engine of a vehicle powered by an internal combustion engine are well known (see for example U.S. Pat. No. 3,220,392 to Cummins) an ideal braking system design characterized by low cost, simplicity, ease of maintenance and reliability has not yet been achieved. One well known approach has been to convert the engine into a compressor by cutting off fuel flow and, opening the exhaust valve for each cylinder near the end of the compression stroke and to close the exhaust valve shortly thereafter; thus, permitting the conversion of the kinetic inertial energy of the vehicle into compressed gas energy which may be released to atmosphere when the exhaust valves are partially opened. To operate the engine reliably as a compressor, rather exacting control is necessary over the timed relationship of exhaust valve opening and closing relative to the movement of the associated piston. One technique for accomplishing this result is disclosed in U.S. Pat. No. 3,786,792 to Pelizzoni et al, wherein the exhaust valve train of an engine is provided with a dual ramp cam and cooperating, hydraulically operated tappet to selectively open and close the exhaust valve as necessary to operate the engine as a gas compressor. The engine braking system of Pelizzoni et al, is desirable and useful in many engine environments but does present cost obstacles when it is desired to retrofit an existing engine since special dual ramp cams must be substituted for the standard exhaust valve cams normally provided in an engine.

An alternative and somewhat less expensive hydraulic system may be employed in certain internal combustion engines by the provision of a slave hydraulic piston for opening an exhaust valve near the end of the compression stroke of an engine piston with which the exhaust valve is associated. The slave piston which opens the exhaust valve is actuated by a master piston hydraulically linked to the slave piston and mechanically actuated by an engine element which is displaced periodically in timed relationship with the compression stroke of the engine piston. One such engine element may be the intake valve train of another cylinder timed to open shortly before the first engine cylinder piston reaches the top dead center of its compression stroke. Other engine operating elements may be used to actuate the master piston of the braking system so long as the actuation of the master piston occurs at the proper moment near the end of the compression stroke of the piston whose associated exhaust valve is to be actuated by the slave piston. For example, certain types of compression ignition engines are equipped with fuel injector actuating mechanisms which are mechanically actuated near the end of the compression stroke of the engine piston with which the fuel injector valve train is associated thus providing an actuating mechanism immediately adjacent the valve which is to be opened all as illustrated in the Cummins U.S. Pat. No. 3,220,392 patent and as further described in U.S. Pat. No. 3,405,699 to Laas.

The use of hydraulically linked master/slave pistons in a system for selectively converting an internal combustion engine from a power mode to a compressor mode of operation has proven to be commercially viable and to be relatively simple especially in engines already equipped with appropriately timed fuel injector actuating mechanisms. However, certain difficulties have arisen in controlling the amount of energy required to operate the slave piston. These difficulties appear to result from variations in engine timing, turbo charging and compression ratio. In particular, it has been found that in the operation of the above described system, frequently, the fuel injector valve trains deform due to undesirably excessive loading by the master pistons, resulting in costly repairs and a total loss in vehicle usage for a lengthy period of time. Prior to the subject invention, no technique had been employed to control effectively and efficiently variations in the energy required by a slave/master hydraulic braking system used to operate an internal combustion engine in a braking mode as a compressor.

SUMMARY OF THE INVENTION

It is a primary object of this invention to overcome the deficiencies of the prior art as noted above by providing a braking system for an internal combustion engine which is capable of opening the exhaust valve at spaced timed intervals relative to the reciprocation of an associated engine piston without imposing excessive strain or causing excessive wear on the parts of the engine used to open the valve during the braking mode of engine operation.

Another object of this invention is to provide a braking system for an internal combustion engine which responds to the variable bias force tending to maintain an engine exhaust valve closed when the engine is operated in a braking mode by delaying the opening of the exhaust valve until the force necessary to open the exhaust valve has receded below a predetermined amount.

Another object of this invention is to provide a fluid circuit in a braking system of the type discussed above employing an opening delay means including a fluid pressure control valve for venting fluid from the fluid circuit of the braking system whenever the pressure in the fluid circuit exceeds a preset limit whereby opening of the exhaust valve at the end of the compression stroke is delayed until the pressure drops below the preset limit.

A more specific object of the invention is to provide a fluid circuit charging apparatus whereby an engine may be caused to operate in the braking mode by selectively charging the fluid circuit with non-compressible fluid and by selectively venting the fluid circuit to prevent opening of the exhaust valve whenever pressure levels above a predetermined limit are present in the fluid circuit. The fluid circuit includes a source of fluid at a pressure substantially less than the preset level, a fluid circuit control means which responds to an operator control signal to cause the selective charging and venting of the fluid circuit. The fluid circuit control means including a dual function slide valve movable between a charging position in which non-compressible fluid may flow into the fluid circuit from a source of non-compressible fluid and a venting position in which additional fluid is blocked from flow into the fluid circuit and the fluid already within the fluid circuit is vented to a sump. A solenoid operated 3-way valve is further provided in the fluid circuit control means for controlling the supply of non-compressible fluid to the dual function slide valve. In order to delay opening of the exhaust valve a fluid pressure control valve is provided for venting fluid from the fluid circuit of the braking system whenever the pressure in the fluid circuit exceeds a preset limit.

Having thus described the invention, broadly, a preferred mode of effecting the concepts involved will become apparent from the preferred detailed description of the preferred embodiment in association with the drawings attached hereinto. Other important advantages and objects of the invention will become apparent from a consideration of the description of the preferred embodiment.

DETAILED DESCRIPTION OF THE DRAWINGS

FIG. 2 is a cross sectional view of a fluid pressure control valve for venting fluid from the fluid circuit of the braking system.

FIG. 3 is a cross sectional view of an alternate embodiment of the fluid pressure control valve of FIG. 2.

DESCRIPTION OF THE PREFERRED EMBODIMENT

Figure 1:
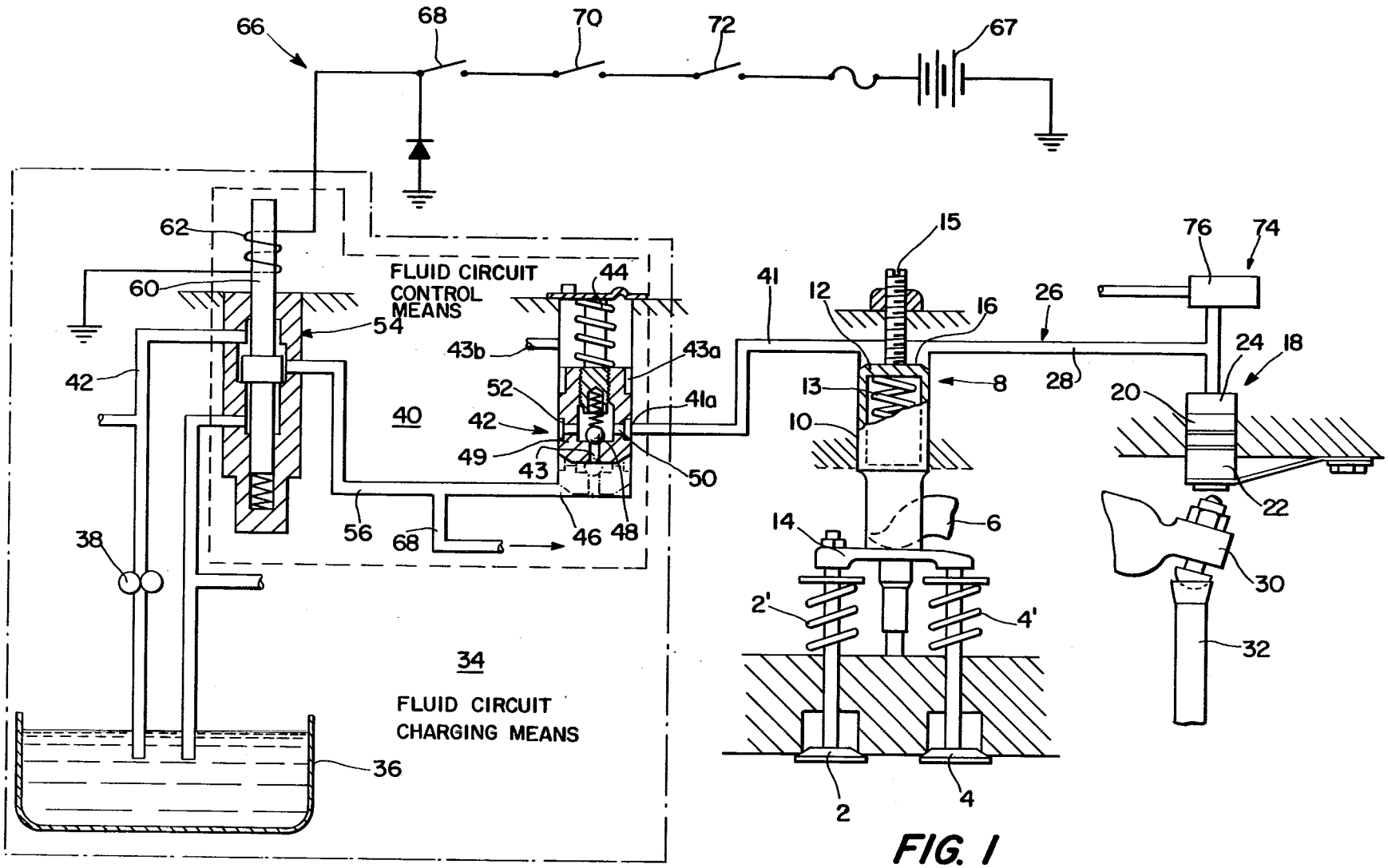
FIG. 1 is a diagrammatic illustration of an electrically and fluidically controlled braking system for a fuel injected internal combustion engine in accordance with the subject invention.

FIG. 1 discloses a specific embodiment of the subject invention as employed in a hydraulically controlled compression braking system of an internal combustion engine equipped with a cam operated fuel injector train, whereby the engine may be converted from a power mode of operation to a braking mode without giving rise to excessive pressure variations in the hydraulic circuit of the retarding system. In particular, the system of FIG. 1 discloses a Jacobs type compression brake system such as disclosed in U.S. Pat. No. 3,405,699 including a pair of exhaust valves 2 and 4 associated with a single engine piston for simultaneous operation by an exhaust rocker lever 6 during the normal power mode of engine operation. In such a power mode, the exhaust rocker lever 6 is connected in a valve train to a rotating cam which is designed to normally leave the exhaust valves closed during the compression and expansion strokes of the associated piston. However, as explained in U.S. Pat. No. 3,405,699 and also in U.S. Pat. No. 3,220,392 it is necessary to open at least partially the exhaust valves near the end of the compression stroke of the associated piston if it is desired to operate the engine as a compressor for braking purposes. As illustrated in FIG. 1 this result may be accomplished by providing an actuating means 8 in the form of a cylinder 10 and hydraulically actuated slave piston 12, mechanically connected to the exhaust valves 2 and 4 by bridging element 14, for opening at least partially valves 2 and 4 whenever the cylinder cavity 16 above slave piston 12 is pressurized by fluid. At all other times slave piston 12 is biased by a spring 13 toward a retracted position as illustrated in FIG. 1. An adjusting screw 15 is provided to permit adjustment of the fully retracted position of the slave piston 12.

In order to provide the necessary fluid pressure to cavity 16, the actuating means 8 is fluidically connected with a fluid pressurzing means 18 which is, in turn, mechanically connected with an engine element operated to be displaced periodically in timed relationship with the movement of the engine piston associated with exhaust valves 2 and 4 so as to cause the exhaust valves to open near the end of the compression stroke of the associated engine piston. The fluid pressurizing means 18 includes a cylinder 20 and master piston 22 slidingly mounted within cylinder 20 to form a cavity 24 above the piston 22 communicating with cavity 16 through a fluid circuit 26 including a fluid conduit 28.

While piston 22 may be displaced by any element within the engine which is mechanically displaced during periodic intervals properly timed with respect to the desired times of opening of exhaust valves 2 and 4, piston 22 is illustrated as being displaceable by means of a fuel injector valve rocker arm 30 which normally exists in engines, equipped with cam actuated fuel injection systems. The fuel injector rocker arm 30 is designed to rotate about a pivot (not illustrated) upon displacement by an injector push rod 32 which, in turn, is engaged by an associated injector rod cam lobe (not illustrated). Use of the fuel injector actuating mechanism to displace the master piston is particularly propitious in an engine equipped with a cam actuated fuel injection system because the fuel injector valve associated with each engine cylinder is timed to be displaced near the end of the compression stroke of the piston within the associated engine cylinder. Thus, the fluid conduit 28 connecting the fluid pressurizing means 18 and the actuating means 8 may be quite short.

A separate fluid conduit 28 is provided for each set of fluidically connected actuating means 8 and fluid pressurizing means 18, whereby the opening of the exhaust valve (or valves) associated with each engine piston may be timed to occur (precisely) near the end of the compression stroke of the associated piston. In order to activate the braking system, however, it is necessary to charge each fluid conduit 28 with a supply of non-compressible fluid such as the engine lubricating oil. In particular a fluid circuit charging means 34 (as encompassed within the dot-dashed line of FIG. 1) may be provided including a sump such as the crankcase 36, a fluid pump such as the lubrication oil pump 38 and a fluid circuit control means 40 (illustrated within dashed lines in FIG. 1) for receiving fluid from pump 38 through conduit 42 and supplying the fluid to the fluid circuit 26 through conduit 41.

Fluid circuit control means 40 includes a dual function slide valve 42 having a sliding member 43 movable between a charging position as (illustrated in solid lines in FIG. 1) in which non-compressible fluid may flow into the fluid circuit 26 and a venting position (illustrated in dashed lines) in which oil from lubrication pump 38 is blocked from flow into the fluid circuit and the non-compressible fluid within the fluid circuit is vented to the crankcase 36 through annular recesses **43*a* and return passage 43*b* when recess 43*a* is in registry with the inlet 41*a* of conduit 41. Since crankcase 36 is at near atmospheric pressure, the pressure within circuit 26 is insufficient to cause the slave piston to open the exhaust valves so long as the slide valve member 43 is in the venting position. A spring 44 is provided to bias the slide valve member 43 toward the venting position. However, the bias of spring 44 is insufficient to hold the dual function slide valve 42 in the venting position when fluid from the pump 38 is passed into the cavity 46 below the slide valve member 43. A check valve 48 is provided within a passage 49 opening into the lower face of the slide member 43 which in combination with transverse passage 50 and annular recess 52 (positioned to register with inlet 41***a* when member 43 is in the charging position) permits fluid to flow into fluid circuit 28 through conduit 41. The lubrication oil supplied by pump 38 is at a sufficiently low pressure in comparison with the bias of spring 13 on slave piston 12 and the closing bias on exhaust valves 46 and 48 produced in part by closing springs 2' and 4' that exhaust vavles can not be opened by the pressure produced by pump 38 alone. Check valve 48 is designed to permit operation of the system by preventing oil from venting from fluid circuits 26 and 41 so long as the slide member 43 remains in the charging position thereby to allow pressure to build up in conduit 26 whenever master piston 22 is displaced upwardly resulting in the downward displacement of slave piston 12 in timed sequence with the movement of injector push rod 32 and rocker arm 30.

Fluid circuit control means 40 further includes a solenoid controlled three way valve 54 for directing oil supplied by pump 38 to interconnecting line 56 which supplies oil to cavity 46 or cuts off the flow of oil from pump 38 and vents oil out of line 56 and back to the crankcase 36 through return line 58. Three way valve 54 includes a movable valve element 60 spring biased toward one position in which the oil is returned from line 56 to the crankcase 36 and movable to another position, against the spring bias, by a solenoid 62 whenever the solenoid is energized, by means of an electrical control circuit 66 illustrated in FIG. 1 and described below. A separate dual function slide valve may be provided for each interconnected slave piston/master piston set corresponding to the number of cylinders in the engine. If it is desired operate all such slave piston/-master piston sets simultaneously, a supply passage 68 is used to supply oil from three way valve 54 to all other slide valves. Thus all pistons are operated in a braking mode substantially simultaneously. Should it be desired to selectively convert individual engine pistons to a braking mode, a separate three way valve must be provided for each slide valve. Alternatively certain cylinders may be grouped together so that, for instance the vehicle operator may selectively convert 2,4,6 or 8 cylinders to a braking mode of operation, in which case a separate three way valve and supply passage 68 is provided for each group of dual function slide valves it is desired to operate in unison.

Turning now to electrical control circuit 66, it can be seen that the circuit includes a plurality of switches connected in series between a battery 67 and the solenoid 62 such that all of the switches must be closed in order for solenoid 62 to be energized and the braking system set into operation. In particular, a fuel pump switch 68 is included to insure that the braking mode of operation is only possible when the engine fuel pump has been turned off. Thus, switch 68 closes only when the fuel pump is returned to idle position off. A clutch switch 70 is also provided so that the engine may only be operated when the clutch is engaged, thereby insuring that the braking effect of the engine is transferred to the vehicle wheels. Finally, a dash switch 72 is provided to permit the vehicle operator to determine when he wishes to obtain braking effect from the vehicle's engine. Other control switches may, of course, be added.

It has been found in the operation of the system as described above that frequently the injector push rod 32 bends, often resulting in engine failure, costly repairs, and a total loss in vehicle usage for a lengthy period of time. Damage to the injector push rod 32 appears to be caused by undesirably excessive loading by the master piston 22. Such loading is a direct function of the pressure within circuit 26 which in turn is dependent on a number of design and operational factors.

Among the design factors which ultimately effect the force exerted by the master piston 22 on the injector push rod 32 are the ratio of effective areas of the slave and master pistons, the master piston travel, engine timing, exhaust valve closing spring bias, and the stress limit and/or yield strength of the injector train. The qualitative effect of each factor is predictable at the design stage and therefore the physical elements involved can be properly chosen so as to minimize the effective force exerted on the injector push rod 32.

On the other hand, a number of operational factors such as intake manifold pressure, peak cylinder pressure, oil pressure, engine RPM, and especially fuel return line cloggs also influence the force on the injector push rod 32. Because these operational factors are constantly varying and unpredictable, the appropriate design choices relating to the injector push rod cannot be made. In fact, tests show that variations in these unpredictable operational factors, when all the above mentioned design factors are held constant, can result in as much as 50% corresponding variation in the force exerted on injector push rod 32. The results of these tests are summarized below in tables 1–5.

TABLE 1

INTAKE MANIFOLD PRESSURE AND INJECTOR PUSH ROD LOAD
Engine RPM 2025 to 2360
Oil Pressure at Cyl. Hd. 25 to 27.5 PSI

| RUN NO. | INTAKE MANIFOLD PRESSURE AT TIME OF MAX. PUSH ROD LOAD, IN. HG | PEAK INJECTOR PUSH ROD LOAD, LB. |
|---|---|---|
| 27-4 | 2.5 | 2625 |
| 37-3 | 5.0 | 2625 |
| 22 | 6.3 | 2850 |
| 37-1 | 13.5 | 3125 |
| 20 | 22.3 | 3000 |

This table discloses the influence of intake manifold pressure and, thus, demonostrates the effect or peak injector push rod load which results from turbocharging/supercharging.

TABLE 2

CYLINDER PRESSURE AND INJECTOR PUSH ROD LOAD
Engine RPM 1900 to 2250
Oil Pressure at Cyl. Hd. 25.0 to 27.5 PSI

| RUN NO. | CYLINDER PRESSURE AT TIME OF MAX. INJECTOR PUSH ROD LOAD, PSI | PEAK INJECTOR PUSH ROD LOAD, LB. |
|---|---|---|
| 24 | 650 | 2875 |
| 25 | 690 | 3050 |
| 32 | 700 | 3160 |
| 30 | 720 | 3150 |
| 26 | 750 | 3050 |
| 69 | 750 | 2900 |
| 47-B | 800 | 3475 |
| 47-A | 830 | 3350 |

Table 2 demonostrates the effect of increased cylinder pressure on the peak injector push rod load such as occurs when higher compression ratio are used, or fuel is injected into the cylinder during braking operation.

TABLE 3

SUPPLY OIL PRESSURE AND INJECTOR PUSH ROD LOAD
Engine RPM 2000–2300
Intake Manifold Pressure 5.3 to 15.0 in. hg

| RUN NO. | OIL PRESSURE AT CYLINDER HD., PSI | PEAK INJECTOR PUSH TUBE ROD, LB |
|---|---|---|
| 49 | 36.0 | 2050 |
| 51 | 32.5 | 2560 |
| 58 | 29.0 | 2975 |
| 69 | 27.5 | 2900 |
| 26 | 27.0 | 3060 |
| 37-2 | 26.5 | 2725 |
| 48 | 26.0 | 3000 |
| 24 | 25.5 | 2875 |
| 25 | 25.0 | 3050 |
| 31-2 | 22.5 | 3125 |

Table 4 discloses the result of reducing oil supply pressure to braking device.

TABLE 4

ENGINE RPM AND INJECTOR PUSH ROD LOAD
Intake Manifold Pressure 6.6 to 9.75 In. Hg
Oil Pressure 25.0 to 27.0 PSI

| RUN NO. | ENGINE RPM | PEAK INJECTOR PUSH TUBE ROD LB. |
|---|---|---|
| 29 | 1905 | 3075 |
| 25 | 2000 | 3050 |
| 26 | 2030 | 3060 |
| 24 | 2060 | 2875 |
| 32 | 2190 | 3160 |
| 30 | 2200 | 3150 |
| 37-2 | 2280 | 2725 |
| 48 | 2300 | 3000 |
| 39-2 | 2375 | 3025 |

TABLE 5

INJECTOR PUSH ROD LOADS WITH FUEL DRAIN LINE CLOGGED
Engine RPM 2020 to 2190
Intake Manifold Pressure 26.25 to 30.9 In. Hg
Oil Pressure 25.0 to 27.5 PSI

| RUN NO. | PEAK INJECTOR PUSH ROD LOAD, LB. |
|---|---|
| 41 | 4725 |
| 42-A | 4710 |
| 44 | 4500 |
| 45 | 4625 |
| 46 | 4725 |

Table 5 illustrates a two-fold effect of the fuel drain line becoming clogged and high intake manifold pressure.

Empirical studies have demonostrated that for many engines, the injector push rod 32 should not receive forces in excess of 3,000 pounds. Yet, as the above test data shows, this amount is frequently exceeded during engine operation. To solve this problem without expensive design changes in the basic components of the engine, it has been found that if the exhaust valve or valves serving a particular cylinder are not opened at the precise point of maximum cylinder compression but rather at a later point in time when the pressure in the cylinder has decreased, a corresponding decrease in pressure will result in circuit 26 which in turn will result in a decrease of the force exerted on injector push rod 32 by the master piston 22. One technique for accomplishing this result is to provide a valve opening delay means 74 for preventing the opening of the exhaust valves upon pressurization of the non-compressible fluid whenever the variable closing bias on the exhaust valves exceeds a pre-determined limit and for maintaining the exhaust valves closed until the variable closing bias again falls below the predetermined limit. The valve delay opening means 74 includes a fluid pressure control valve 76 connected with fluid conduit 28 for venting fluid from conduit 28 whenever the pressure within the conduit reaches a predetermined level which, if exceeded, would cause the slave piston to overcome the closing bias on the exhaust valve. The determination of this predetermined limit can be made on the basis of the formula $P=(F/A)$, where F is the maximum permissible forces which the injector push rod 32 can withstand, and A is the cross-sectional areas of the master piston 22. For the engine used in the above tests, A is 0.592 in.$^2$ and F is 3000 pounds. Hence the predetermined limit is 5070 pounds per square inch. Should a fluid pressure control valve not be available at this precise predetermined limit, however, any limit between 4900 PSI and 5100 PSI would be within the acceptable tolerance range. In addition to responding at the appropriate static pressure related to the maximum safe loading on the fuel injector actuating mechanism, the fluid pressure control valve must also have appropriate dynamic characteristics so as to be capable of dumping enough fluid within a sufficiently short time in order to insure that excessive pressure does not build up within the fluid circuit between the master and slave cylinder. In particular, it has been determined that a pressure relief valve which is capable of dumping a volume of fluid equal to the displacement volume of the master piston during each injection of an engine running at 2100 RPM would be capable of handling the expected dynamic characteristics. At 2100 RPM, 1050 injections per minute are made or 17.5 injection per second. The volume displacement of a typical master piston having a diameter of 0.8755 in$^3$ and a stroke of 0.170 in is 0.704 in$^3$. Thus, a pressure relief valve having a 0.10 in$^3$ capacity at 17.5 cycles/second would represent an optimum design.

FIGS. 2 illustrates one embodiment of the fluid pressure control valve 76 designed in accordance with the subject invention including a housing 78 containing an inlet port 80 connected to the fluid circuit 26 by a conduit 82, and an outlet port 84 connected by a return line 83 to crankcase 36. Housing 78 also contains an internal cavity 86 communicating with ports 80 and 84 having an interior side wall 85 sloping toward the inlet port 80 to form a cavity having a decreasing cross-sectional area from said outlet port 84 to said inlet port 80. Outlet port 84 communicates with the internal cavity 86 by opening into the sloping side wall 85. A floating ball 88 is biased by spring 90 toward the inlet port 80 to prevent flow of oil into the internal cavity except when the pressure within circuit 26 exceeds the predetermined level. When such predetermined pressure level is reached, ball 88 is moved toward the right as illustrated in FIG. 2 to cause fluid to be vented from circuit 26 and returned to the engine crankcase.

A second embodiment of the fluid pressure control valve is illustrated in FIG. 3 wherein those elements identical to the embodiment of FIG. 2 have been identified by the same reference numerals. As is clear from FIG. 3, outlet port 84' is connected with housing 78' to communicate with cavity 86 at an end opposite the end of cavity 86 at which inlet port 80 communicates with cavity 86.

The pressure relief valve of this embodiment is provided with a screw thread fitting 92 about the inlet port 80 for mating with a screw threaded opening 92 formed directly into the master cylinder 20, whereby the relief valve may be mounted directly on the master cylinder 20. This arrangement causes the valve to respond immediately to any pressure build up within the master cylinder before such pressures become excessive.

To operate the braking system, the electrical control circuit must be conditioned to supply current to the three way solenoid valve 54 by closing fuel pump switch 68, the clutch switch 70 and the dash switch 72. When so set, the electrical control circuit energizes solenoid 62 forcing the control valve member 60 downwardly to cause fluid flow from pump 38 through three way control valve into conduit 56 forcing the slide valve member 48 upwardly to its charging position. Fluid flowing through conduit 41 has the additional effect of opening the ball check valve 48 to charge fluid circuit 26. However, at this point the pressure in the fluid circuit 26 is still not enough to force the slave piston 12 downwardly to open the valves 2 and 4 and allow the associated engine cylinder (not illustrated) to act as a compessor. At the appropriate time in the engine cycle the injector push rod 32 is forced upwardly against the master piston 22 thereby increasing the pressure in the fluid circuit 26 sufficiently to force the slave piston 12 downwardly in order to open valves 2 and 4. Upon return of the injector push rod, slave piston 12 is caused to retract and close the exhaust valves so that a new charge of air may be drawn into the cylinder, compressed and released upon the next advance of the injector push rod 32. By virtue of valve opening delay means 74, the pressure within fluid circuit 26 never builds up to an excessive level such as would damage the engine. Thus, the fluid pressure control valve 76, as illustrated in either FIG. 2 or FIG. 3, serves to maintain the pressure in the fluid circuit 26 below a certain limit by allowing fluid to flow from the fluid circuit 26 through the fluid pressure control valve 74 and back to the crankcase 36. This has the effect of delaying the opening of the exhaust valves 2 and 4 until the pressure in the fluid circuit 26 has receded below a maximum limit thereby preventing excessive wear or damage on the system.

The utility of subject invention has been confirmed by actual road tests on a vehicle equiped with a fluidic exhaust valve opening system having a valve opening delay means such as described above. In particular the tests were conducted in a Kenworth K-100 chassis powdered by a Cummins NTC-350 engine, S/N 10339076 and equiped with a Fuller RTO-910 transmission and a Rockwell SQHD 4.44:1 tandem drive axle. The tests were conducted under the conditions indicated in the following tables:

TABLE 6

INJECTOR PUSH ROD LOADS
Fuel Drain Line Restricted with 0.070 In. Orifice
Engine RPM 2100 to 2300
Intake Manifold Pressure 11.25 to 12.5 In Hg
Oil Pressure 25.0 to 27.5 PSI

| Run No. | Peak Injector Push Rod Load, Lb. No Delay Means Valve | Peak Injector Push Rod Load, Lb. Valve Delay Means Activated |
|---|---|---|
| 42-B | 3500 | |
| 59 | | 3200 |
| 43 | 3450 | |

TABLE 7

INJECTOR PUSH ROD LOADS
Fuel Drain Line 100% Restricted
Engine RPM 2000 to 2100
Intake Manifold Pressure 22.5 to 30.4 In. Hg

| Run No. | Peak Injector Push Rod Load, Lb. No Delay Means Valve | Peak Injector Push Rod Load, Lb. Valve Delay Means Activated |
|---|---|---|
| 44 | 4500 | |
| 53 | | 3060 |
| 45 | 4625 | |
| 62 | | 3150 |
| 46 | 4725 | |

Obviously the valve delay means has the effect of limiting the force imposed on the injector push rod under conditions that would otherwise produce excessive loading.

An engine braking or retarding system has been described which is characterized by low cost, simplicity, ease of maintenance and reliability and at the same time prevents excessive wear and damage to the engine by limiting maximum back pressure in the fluid line connecting the master and slave pistons. As is evident from the diagramatic illustration of the preferred embodiment in FIG. 1 the system is sufficiently simple to be easily retro-fitted in an existing engine without major modification especially. Since the load imposed on the operating elements may be strictly limited.

I claim:

1. A braking system for a fuel injected internal combustion engine having at least one piston reciprocatively mounted within a cylinder for cyclical successive compression and expansion strokes and an exhaust valve operable against variable closing bias to exhaust gas from the cylinder in variable timed relationship to the piston strokes to operate the engine in either a power mode or a braking mode and having a fuel injector train mechanically actuated near the end of each compression stroke of the piston to inject fuel into the cylinder when the engine is operated in the power mode, said braking system comprising:

a. fluid pressurizing means mechanically linked with the fuel injector train for pressurizing a non-compressible fluid in response to the mechanical actuation of the fuel injector train whenever the engine is operated in the braking mode;

b. actuating means fluidically linked to said pressurizing means and mechanically linked to the exhaust valve for opening the exhaust valve whenever the level of pressurization of the non-compressible fluid is sufficient to overcome all forces biasing the exhaust valve to a closed position; and c. valve opening delay means for preventing the opening of the exhaust valve upon pressurization of the non-compressible fluid whenever the variable closing bias on the exhaust valve exceeds a predetermined limit and for maintaining the exhaust valve closed until the variable closing bias again falls below the pre-determined limit, thereby preventing fluid pressure buildup above a pre-determined magnitude which would tend to damage the fuel injector train.

2. A braking system as defined in claim 1, further including a fluid circuit interconnecting said fluid pressurizing means and said actuating menas, said valve opening delay means including a fluid pressure control valve connected with said fluid circuit for venting fluid from said fluid circuit whenever the pressure within said fluid circuit reaches a predetermined level which would cause said actuating means to overcome a closing bias on the exhaust valve exceeding said predetermined limit, thereby preventing said actuating means for opening the exhaust valve unless the closing bias is below the predetermined upper limit.

3. A braking system as defined in claim 2, wherein said predetermined level is at least 4900 pounds per square inch but not more than 5100 pounds per square inch.

4. A braking system as defined in claim 2, further including fluid circuit charging means for selectively charging said fluid circuit with non-compressible fluid to cause the engine to operate in the braking mode and for selectively venting said fluid circuit to prevent opening of the exhaust valve by said actuating means, said fluid circuit charging means including a source of fluid at a pressure substantially less than said predetermined level.

5. A braking system as defined in claim 4, wherein said fluid circuit charging means further includes fluid circuit control means for responding to an operator control signal to cause said selective charging and venting of said fluid circuit, said fluid circuit control means including a dual function slide valve movable between a charging position in which non-compressible fluid may flow into said fluid circuit from said source of non-compressible fluid and a venting position in which fluid from said source of non-compressible fluid is blocked from flow into said fluid circuit and the non-compressible fluid within said fluid circuit is vented to a fluid sump at a pressure below which the exhaust valve can not be opened by said actuating means.

6. A braking system as defined in claim 5, wherein said dual function slide valve is spring biased toward said venting position and further wherein said fluid circuit control means further includes a solenoid operated three way valve movable between a first position in which fluid from said source of non-compressible fluid is provided to one end of said dual function slide valve to bias said dual function slide valve against said spring bias toward said charging position and a second position in which non-compressible fluid is vented from said one end of said slide valve to cause said slide valve to move to said venting position.

7. A braking system as defined in claim 2, wherein said fluid pressure control valve includes:

(a) a housing containing inlet and outlet ports communicating with said internal cavity, said inlet port and said outlet port being fluidically connected with said fluid circuit and a fluid sump, respectively, said internal cavity having a side wall sloping toward said inlet port to form an internal cavity having an increasing cross-sectional area from said inlet port to said outlet port; and (b) a valve member movable between a closed position in which fluid is prevented from flowing from said inlet port to said outlet port and open position in which fluid may flow from said inlet port to said outlet port, and a biasing means for biasing said valve member toward said closed position with a force which is sufficient to prevent movement of said valve member toward said open position until the fluid pressure within said fluid circuit reaches said predetermined level.

8. A braking system as defined in claim 7, wherein said outlet port is positioned within said housing to open into said internal cavity through said sloping wall.

9. A braking system as defined in claim 7, wherein said inlet port is positioned at one end of said internal cavity and said outlet port is positioned adjacent an opposite end of said internal cavity.

10. A braking system as defined in claim 7, wherein said valve member is a ball and said baising means is a spring having a predetermined compressive force to hold said valve member in said closed until the fluid pressure within said fluid circuit reaches said predetermined level.

11. A braking system for an internal combustion engine having at least one piston reciprocatively mounted within a cylinder for cyclical successive compression and expansion strokes and an exhaust valve operable against variable closng bias to exhaust gas from the cylinder in variable timed relationship to the piston strokes to operate the engine in either a power mode or a braking mode and having an engine component displaceable in timed relationship with the reciprocating piston, said braking system comprising (a) engine operating means cyclically actuated for providing mechanical displacement of the engine component during spaced timed intervals near the end of the compression stroke of the reciprocating piston and for providing a source of actuating energy up to a predetermined maximum amount without causing damage or excessive wear to the engine;

(b) fluid pressurizing means mechanically linked with said engine operating means for using said actuating energy of said engine operating means to pressurize a non-compressible fluid in response to the mechanical displacement of said engine operating means whenever the engine is operated in the braking mode;

(c) actuating means fluidically linked to the exhaust valve for opening the exhaust valve whenever the level of pressurization of the non-compressible fluid is sufficient to overcome all forces biasing the exhaust valve to a closed position; and (d) valve opening delay menas for preventing the opening of the exhaust valve upon pressurization of the non-compressible fluid whenever the variable closing bias on the exhaust valve causes said actuating energy used by said fluid pressurizing means to reach said predetermined maximum amount and for maintaining the exhaust valve closed until the variable closing bias again falls below the predetermined limit, thereby preventing the actuating energy used by said pressurizing means from exceeding said predetermined maximum amount.

12. A braking system as defined in claim 11, wherein said engine operating means includes a fuel injector valve train associated with the reciprocating piston and said engine component is the rocker arm of said fuel injector valve train.

13. A braking system as defined in claim 2, wherein said fluid pressure control valve has a displacement capability in excess of 0.10 $in^3$ when operating at 17 strokes per second.

* * * * *